US009567172B2

(12) United States Patent
Chiba et al.

(10) Patent No.: US 9,567,172 B2
(45) Date of Patent: Feb. 14, 2017

(54) IMAGE FORMING APPARATUS

(71) Applicant: CANON KABUSHIKI KAISHA, Tokyo (JP)

(72) Inventors: Yoshinao Chiba, Toride (JP); Shinsuke Ubayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/790,094

(22) Filed: Jul. 2, 2015

(65) Prior Publication Data

US 2015/0298922 A1 Oct. 22, 2015

Related U.S. Application Data

(62) Division of application No. 14/465,858, filed on Aug. 22, 2014, now Pat. No. 9,102,488.

(30) Foreign Application Priority Data

Sep. 18, 2013 (JP) ..... 2013-192766

(51) Int. Cl.
*B65H 1/22* (2006.01)
*B65H 1/12* (2006.01)
(Continued)

(52) U.S. Cl.
CPC *B65H 1/12* (2013.01); *B65H 1/04* (2013.01); *B65H 1/14* (2013.01); *B65H 1/266* (2013.01);
(Continued)

(58) Field of Classification Search
CPC ..... B65H 1/00; B65H 1/04; B65H 1/12; B65H 1/14; B65H 2402/64; B65H 2402/5155; B65H 2405/10; B65H 2405/12; B65H 2405/121; B65H 2405/31; B65H 2405/32; B65H 2405/114; B65H 1/26; B65H 1/266
(Continued)

(56) References Cited

U.S. PATENT DOCUMENTS 5,722,652 A 3/1998 Yoshida et al.
6,651,980 B2 11/2003 Isemura et al.
(Continued)

FOREIGN PATENT DOCUMENTS

JP 08-301464 A 11/1996
JP 52-037817 U 3/1997
(Continued)

OTHER PUBLICATIONS

Japanese Office Action issued in corresponding Japanese Application No. 2013-192766 dated Aug. 17, 2015.

*Primary Examiner* — Prasad Gokhale
(74) *Attorney, Agent, or Firm* — Fitzpatrick, Cella, Harper & Scinto

(57) ABSTRACT

By abutting a positioning member against an abutting surface provided in an image forming apparatus body, positioning in a mounting direction of a sheet storing portion drawably mounted on the image forming apparatus body. A position of the positioning member is changed stepwise by a support portion having a receiving surface abutting against the positioning member, and the shift of the sheet storing portion positioned by the positioning member with respect to the image forming portion is adjusted stepwise.

9 Claims, 10 Drawing Sheets

(51) Int. Cl.
*B65H 1/04* (2006.01)
*B65H 1/26* (2006.01)
*B65H 1/14* (2006.01)

(52) U.S. Cl.
CPC ..... *B65H 2405/114* (2013.01); *B65H 2405/31* (2013.01); *B65H 2405/32* (2013.01)

(58) Field of Classification Search
USPC ..... 271/145, 162, 164
See application file for complete search history.

(56) References Cited

U.S. PATENT DOCUMENTS 6,804,473 B2 10/2004 Nakamura et al.
7,404,555 B2 7/2008 Yonemoto
7,604,232 B2 * 10/2009 Nakashima ..... B65H 1/26 271/164
7,900,911 B2 3/2011 Ubayashi
8,002,269 B2 * 8/2011 Asada ..... B65H 1/04 271/145
8,061,707 B2 * 11/2011 Sugishima ..... B65H 1/266 271/145
8,066,277 B2 11/2011 Ubayashi
8,205,875 B2 * 6/2012 Kusumi ..... B65H 5/38 271/162
8,246,039 B2 8/2012 Koga et al.
8,387,970 B2 * 3/2013 Ubayashi ..... B65H 1/266 271/145
8,532,557 B2 9/2013 Kusumi et al.
8,651,477 B2 2/2014 Chiba
8,770,577 B2 * 7/2014 Onodera ..... B65H 3/44 109/73
9,102,489 B2 * 8/2015 Uohashi ..... B65H 1/266
2006/0180996 A1 * 8/2006 Iwase ..... G03G 15/6502 271/162
2006/0228122 A1 10/2006 Kamei et al.
2007/0040324 A1 2/2007 Kim
2007/0045946 A1 3/2007 Nakashima et al.
2008/0117482 A1 5/2008 Kusumi
2008/0180764 A1 7/2008 Wakiyama et al.
2010/0183350 A1 7/2010 Ikeda et al.
2010/0187754 A1 7/2010 Ubayashi
2011/0013973 A1 1/2011 Kusumi et al.

FOREIGN PATENT DOCUMENTS

JP 2003-300635 A 10/2003
JP 2006-131396 A 5/2006
JP 2011-037629 A 2/2011
JP 2011-042453 A 3/2011

* cited by examiner

IMAGE FORMING APPARATUS

This application is a division of application Ser. No. 14/465,858 filed Aug. 22, 2014.

BACKGROUND OF THE INVENTION

Field of the Invention

The present invention relates to an image forming apparatus, and more particularly, to a structure for positioning a sheet storing portion when the sheet storing portion is mounted on an image forming apparatus body.

Description of the Related Art

In the past, in an image forming apparatus, such as a copying machine or a printer, a sheet feeding device for supplying a sheet to an image forming portion is provided. The sheet feeding device includes a sheet feeding cassette that is mounted on an image forming apparatus body to store a sheet, and a feeding portion that feeds a sheet stored in the sheet feeding cassette. In a conventional image forming apparatus, a mounting direction of the sheet feeding cassette is a direction perpendicular to a sheet feeding direction. In the case of this apparatus, when the sheet feeding cassette is mounted within the image forming apparatus body, the mounting direction of the sheet feeding cassette is positioned by a positioning portion.

In the image forming apparatus, it is necessary to form an image at an appropriate position of a sheet in the image forming portion. Therefore, a position of an end in a width direction of the sheet stored in the sheet feeding cassette is matched with a position corresponding to a position of an end in a width direction of the image formed by the image forming portion, such that a position of the sheet in the width direction perpendicular to the sheet feeding direction is matched with the image. Therefore, the image can be formed in the image forming portion at an appropriate position in the width direction of the sheet fed from the sheet feeding cassette. However, the positions of the sheet feeding cassette and the image forming portion are shifted by a variation in dimensions of parts or a deformation of parts caused by an installation location of the image forming apparatus body. When the sheet feeding cassette and the image forming portion are mismatched in the width direction, the shift in the width direction occurs in the image formed on the sheet in the image forming portion.

Therefore, the conventional image forming apparatus is provided with a mechanism that adjusting the shift in the width direction of the sheet feeding cassette by the positioning portion with respect to the position of the image of the image forming portion. In this mechanism, the position of the sheet feeding cassette positioned by the positioning portion can be changed in the mounting direction of the sheet feeding cassette. For example, when the position of the sheet feeding cassette is changed by the positioning portion, first, the sheet feeding cassette is positioned by catching a hook provided in the sheet feeding cassette by a hook latch provided in the image forming apparatus body. Then, the position in the mounting direction of the sheet feeding cassette is adjusted by changing the position of the hook hatch through a ration of an adjusting screw attached to the image forming apparatus body (see Japanese Patent Laid-Open No. 2003-300635).

However, the positioning of the sheet feeding cassette in the conventional image forming apparatus is a stepless positioning because the sheet feeding cassette is positioned by rotating the adjusting screw. Therefore, the adjusting screw is rotated excessively or insufficiently by an operator, and the position adjustment in the mounting direction of the sheet feeding cassette cannot be performed easily and reliably.

SUMMARY OF THE INVENTION

However, the conventional image forming apparatus has the sheet feeding cassette capable of adjusting its position by adjusting screw rotatable without going through stages. Therefore, the present invention has been made in view of such circumstances and it is desirable to provide an image forming apparatus capable of easily and reliably adjusting positioning of a sheet storing portion.

According to the present invention, an image forming apparatus includes: an image forming portion; a sheet storing portion which is drawably mounted on an image forming apparatus body; a sheet feeding portion which feeds a sheet stored in the sheet storing portion toward the image forming portion in a direction perpendicular to a mounting direction of the sheet storing portion; a positioning portion which is provided to protrude from one of the sheet storing portion and the image forming apparatus body to the other, and performs positioning in the mounting direction of the sheet storing portion mounted in the image forming apparatus body by abutting against an abutting portion provided in the other of the sheet storing portion and the image forming apparatus body; and an adjusting portion which adjusts the positioning portion so as to adjust a positioning position in the mounting direction of the sheet storing portion with respect to the image forming apparatus body, wherein the positioning portion includes a positioning member which abuts against the abutting portion, and a support portion which supports the positioning member, and the adjusting portion includes a plurality of teeth formed along an inclined surface which is provided in the positioning member and is oblique to the mounting direction, and a plurality of teeth formed on a surface which is provided in the support portion and faces the inclined surface, and moves the positioning member in a direction crossing the mounting direction of the sheet storing portion and adjusts a protruding amount of the positioning portion by changing an engagement position between the teeth of the inclined surface of the positioning member and the teeth of the support portion.

Further features of the present invention will become apparent from the following description of exemplary embodiments with reference to the attached drawings.

DESCRIPTION OF THE EMBODIMENTS

Figure 1:
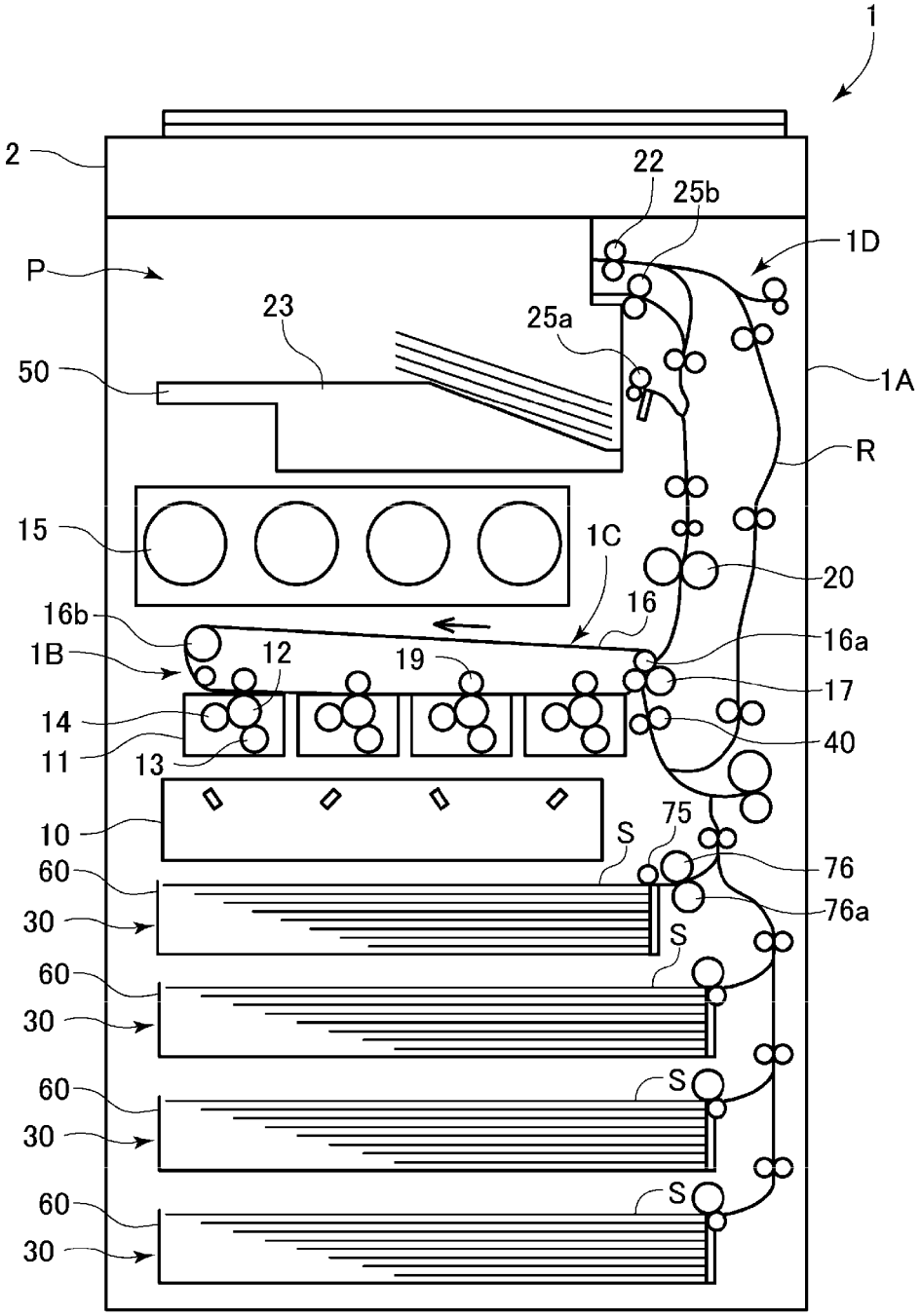
FIG. 1 is a diagram illustrating a schematic configuration of a full-color laser beam printer which is an example of an image forming apparatus according to a first embodiment of the present invention.

Hereinafter, embodiments of the present invention will be described in detail with reference to the drawings. FIG. 1 is a diagram illustrating a schematic configuration of a full-color laser beam printer which is an example of an image forming apparatus according to a first embodiment of the present invention. In FIG. 1, a full-color laser beam printer 1 (hereinafter, referred to as a printer) includes a printer body 1A, which is an image forming apparatus body, and an image forming portion 1B which forms an image on a sheet. An image reading apparatus 2 is installed substantially horizontally above the printer body 1A, and a discharge space P for sheet discharging is formed between the image reading apparatus 2 and the printer body 1A. A sheet feeding device 30 feeds a sheet S from a sheet feeding cassette 60 which is a sheet storing portion storing the sheet S.

The image forming portion 1B which is an image forming portion is a 4-drum full-color system and includes a laser scanner 10 and four process cartridges 11 which form toner images of four colors of yellow (Y), magenta (M), cyan (C), and black (K). Each of the process cartridges 11 includes a photosensitive drum 12, a charging device 13 which is a charging portion, and a development device 14 which is a development portion. Also, the image forming portion 1B includes an intermediate transfer unit 1C disposed above the process cartridges 11, and a fixing portion 20. Incidentally, a toner cartridge 15 supplies a toner to the development device 14.

The intermediate transfer unit 1C includes an intermediate transfer belt 16 wound around a drive roller 16*a* and a tension roller 16*b*, and a primary transfer roller 19 provided within the intermediate transfer belt 16 and abutting against the intermediate transfer belt 16 at a position facing the photosensitive drum 12. Herein, the intermediate transfer belt 16 is rotated in a direction of an arrow by the drive roller 16*a* driven by a driving portion (not illustrated).

The respective color toners with a negative polarity on the photosensitive drum are sequentially multiple-transferred to the intermediate transfer belt 16 by the primary transfer roller 19. A secondary transfer roller 17, which transfers the color images formed on the intermediate transfer belt to the sheet S, is provided at a position facing the drive roller 16*a* of the intermediate transfer unit 1C. Furthermore, the fixing portion 20 is disposed above the secondary transfer roller 17. A pair of first discharge rollers 25*a*, a pair of second discharge rollers 25*b*, and a screen inverting portion 1D are disposed in a left upper part of the fixing portion 20. The screen inverting portion 1D includes a pair of reversing rollers 22 capable of rotating normally or reversely, and a re-conveyance path R which conveys a sheet, on one surface of which an image is formed, to the image forming portion 1B.

Next, an image forming operation of the printer 1 will be described. First, when image information of an original is read by the image reading apparatus 2, the image information is converted into an electric signal after image processing and is transmitted to the laser scanner 10 of the image forming portion 1B. In the image forming portion 1B, the surface of the photosensitive drum 12, which is uniformly charged to a predetermined polarity and voltage by the charging device 13, is sequentially exposed by a laser beam. Therefore, electrostatic latent images of yellow, magenta, cyan, and black are sequentially formed on the photosensitive drums of the respective process cartridges 11.

After that, the electrostatic latent images are developed and visualized by the respective color toners, and the respective color toner images on the respective photosensitive drums are sequentially transferred to the intermediate transfer belt 16 in a superimposing manner by a primary transfer bias applied to the primary transfer roller 19. Therefore, the toner images are formed on the intermediate transfer belt 16. Also, in parallel to the toner image forming operation, a sheet S is fed from a pickup roller 75 provided in the sheet feeding device 30. The fed sheet S is conveyed to a pair of registration rollers 40 by being separated one by one by a separating portion including a feed roller 76 and a retard roller 76*a*. Skew feeding is corrected by the pair of registration rollers 40.

After the skew feeding is corrected, the sheet S is conveyed to the secondary transfer portion by the pair of registration rollers 40. In the secondary transfer portion, the toner images are transferred on the sheet S in a lump by a secondary transfer bias applied to the secondary transfer roller 17. Then, the sheet S, on which the toner images are transferred, is conveyed to the fixing portion 20. In the fixing portion 20, the respective color toners are melted and mixed by heat and pressure and are fixed on the sheet S as a color image.

After that, the sheet S, on which the image is fixed, is discharged to the discharge space P by the pair of first discharge rollers 25*a* and 25*b* provided downstream of the fixing portion 20 and is stacked in a stacking portion 23 protruding from a bottom of the discharge space P. Incidentally, when an image is formed on both sides of the sheet S, after the image is fixed, the sheet S is conveyed to the re-conveyance path R by the pair of reversing rollers 22 and is conveyed again to the image forming portion 1B.

Figure 2:
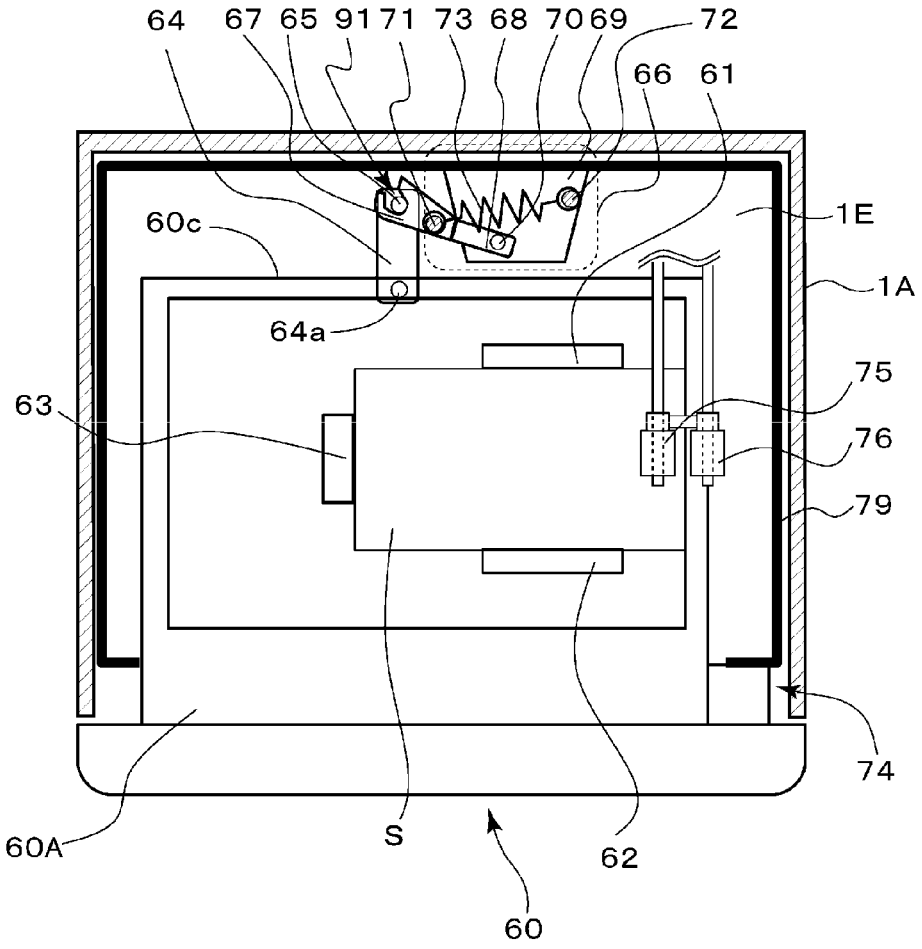
FIG. 2 is a diagram describing a configuration of a mounting portion and a sheet feeding cassette drawably mounted on the mounting portion in the full-color laser beam printer.

Herein, the sheet feeding cassette 60, which is the sheet storing portion, is drawably mounted on a mounting portion 1E formed in a lower portion of the printer body 1A as illustrated in FIG. 2 As illustrated in FIG. 2, a rear side regulating plate 61 and a front side regulating plate 62 are provided in the sheet feeding cassette 60 to regulate a position of the sheet S in a direction (depth direction) perpendicular to a sheet feeding direction. Also, a rear end regulating plate 63 is provided in the sheet feeding cassette 60 to regulate a rear end position of the sheet S disposed at an upstream end of the sheet feeding direction. Furthermore, a sheet supporting plate (not illustrated), in which the sheet S is stacked, is provided in the sheet feeding cassette 60. The position of the sheet, which is stacked in the sheet supporting plate, is regulated by the rear side regulating plate 61, the front side regulating plate 62, and the rear end regulating plate 63.

Also, in a rear sidewall 60*c* of the sheet feeding cassette body 60A of the sheet feeding cassette 60, a swing arm 64 having a swing pin 65 at a distal end portion is swingably supported with a shaft 64*a* as a supporting point. Also, on a rear inner-wall surface of the mounting portion 1E, a guiding unit 66, which is a guiding portion, is provided to guide the sheet feeding cassette 60 to the mounting portion 1E. The guiding unit 66 includes a guiding unit base 69, a guiding hook 67 provided at a leading end, and a guiding arm 68 supported rotatably around a supporting point 70 on the guiding unit base 69.

A concave portion 91 which latches the swing pin 65 of the swing arm 64 is formed in the guiding hook 67 of the guiding arm 68. Also, an arm pin 71 is provided between the guiding hook 67 of the guiding arm 68 and the supporting point 70. One end of a tension spring 73 is latched to a base pin 72 provided in the guiding unit base 69, and the other end of the tension spring 73 is latched to the arm pin 71. The guiding arm 68 is biased by the tension spring 73 such that the guiding arm 68 rotates around the supporting point 70.

Also, when the sheet feeding cassette 60 is pulled out, while the concave portion 91 is latched to the swing pin 65, the guiding arm 68 rotates counterclockwise from a position illustrated in FIG. 2 around the supporting point 70 in a pulling direction against the tension spring 73. After that, when the sheet feeding cassette 60 is further pulled out, the guiding arm 68 is rotated to a standby position at which the latching of the swing pin 65 is released by the concave portion 91. Incidentally, before rotating to the standby position, when the guiding arm 68 is rotated by a predetermined amount, a counterclockwise rotating force is added to the guiding arm 68 by the tension spring 73. Due to the force, the guiding arm 68 is moved to the standby position and then is stopped by abutting against a stopper (not illustrated).

When the guiding arm 68 is at the standby position, the swing pin 65 of the swing arm 64 provided in the sheet feeding cassette 60 mounted on the printer body 1A is entered into the concave portion 91 of the guiding hook 67. Therefore, when the sheet feeding cassette 60 is inserted into the mounting portion 1E, the swing pin 65 is entered into the concave portion 91 of the guiding hook 67. After that, when the sheet feeding cassette 60 is further inserted, the guiding arm 68 is pressed against the rear side through the swing pin 65 and the guiding hook 67.

Therefore, the guiding arm 68 rotates around the supporting point 70 clockwise against the tension spring 73, and after that, when the guiding arm 68 rotates to a predetermined position, the guiding arm 68 rotates clockwise by applying a biasing force to the guiding arm 68 by the tension spring 73. In the process in which the guiding arm 68 rotates clockwise, the concave portion 91 of the guiding hook 67 is latched to the swing pin 65. As a result, when the guiding arm 68 is rotated by the tension spring 73, the sheet feeding cassette 60 is mounted while receiving the biasing force of the mounting direction through the guiding arm 68 by the tension spring 73. Incidentally, after the sheet feeding cassette 60 is mounted, the sheet supporting plate vertically rotatably provided on the sheet feeding cassette body 60A is lifted, and the sheet S on the sheet supporting plate abuts against the pickup roller 75.

By the way, as illustrated in FIG. 2, when the sheet feeding cassette 60 is mounted on one end (right end) perpendicular to the mounting direction upstream of the mounting direction of the sheet feeding cassette body 60A, the positioning portion 74 is provided to performing the positioning in the mounting direction (depth direction) of the sheet feeding cassette 60. When the sheet feeding cassette 60 is mounted, the positioning in the mounting direction of the sheet feeding cassette 60 is performed by the positioning portion 74. The reason why the positioning in the mounting direction of the sheet feeding cassette 60 is performed by the positioning portion 74 will be described below.

With respect to the sheet S fed from the sheet feeding cassette 60, an image needs to be formed at an appropriate position by the image forming portion 1B. In other words, the position of the side end in the width direction (direction perpendicular to the feeding direction) of the sheet S to be fed and the position of the side end in the width direction of the image to be formed on the sheet S by the image forming portion 1B need to have a certain relationship. Thus, the image is formed at the appropriate position with respect to the sheet. By performing the positioning in the mounting direction of the sheet feeding cassette 60, the position of the side end in the width direction of the sheet S to be stored is made constant in the mounting direction.

The sheet S is fed to the image forming portion from the sheet feeding cassette 60 which is in a state of being mounted such that the sheet feeding cassette 60 is positioned at a position at which the positioning is performed (hereinafter, referred to as a positioning position). Incidentally, since the sheet S stored in the sheet feeding cassette 60 is positioned by the rear and front side regulating plates 61 and 62, the position of the side end of the sheet S is determined by determining the position with respect to the sheet feeding cassette body 60A and positioning the sheet feeding cassette body 60A.

Figure 3:
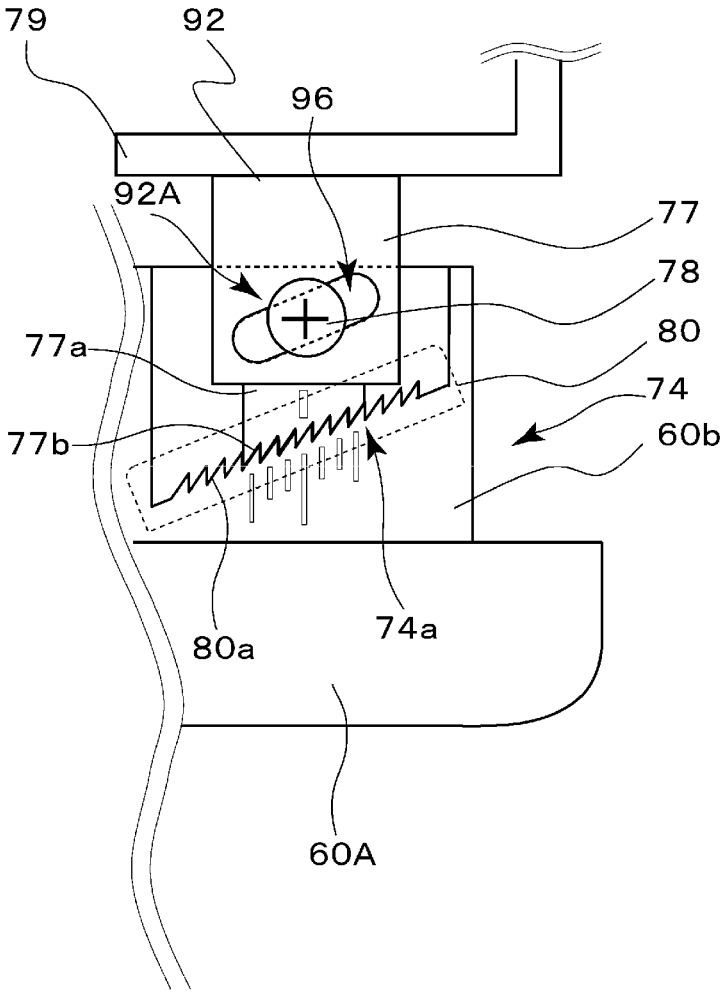
FIG. 3 is a diagram describing a configuration of a positioning portion of the sheet feeding cassette.

As illustrated in FIG. 3, the positioning portion 74 includes a support portion 60*b* provided in the sheet feeding cassette body 60A, and a positioning member 77 supported to the support portion 60*b* movably in a direction perpendicular to the mounting direction and fixed to the support portion 60*b* by a screw 78. When the sheet feeding cassette 60 is mounted on the printer body 1A, the positioning in the mounting direction of the sheet feeding cassette 60 is performed in such a manner that the positioning member 77 abuts against an abutting surface 92, which is an abutting portion of a body frame 79.

A description is given of an adjusting portion 92A which adjusts a position positioning the sheet feeding cassette 60 by the positioning portion 74 and a position positioning in the mounting direction of the sheet feeding cassette 60 by moving in the mounting direction of the sheet feeding cassette 60.

The adjusting portion 92A includes the support portion 60*b*, a latch portion 77*a* provided in the positioning member 77, a screw 78 to be described below, and a screw through-hole 96 which is an elongated hole into which the screw 78 is inserted. The support portion 60*b* supports the positioning member 77 movably in a crossing direction oblique to the mounting direction. A receiving surface 80 which is a guide surface inclined with respect to the mounting direction (inclined surface) is provided in the support portion 60*b*, and a rack 80*a* is formed on the receiving surface 80. In the rack 80*a*, a plurality of triangular teeth each including two inclined surfaces is formed along the inclined guide surface of the receiving surface 80.

Also, the latch portion 77*a* is provided in the positioning member 77. At one end of the latch portion 77*a*, a rack 77*b* constituting an engagement portion 74*a* together with the rack 80*a* of the receiving surface 80 is formed. In the rack 77*b*, a plurality of triangular teeth each including two inclined surfaces is formed along the inclined surface of the latch portion 77*a*. The positioning member 77 is fixed to the sheet feeding cassette 60 through the support portion 60*b* in a state in which the rack 80*a* of the receiving surface 80 is engaged with the rack 77*b* of the latch portion 77*a*.

When the sheet feeding cassette 60 is inserted into the mounting portion 1E, if the positioning member 77 collides with the abutting surface 92, the positioning member 77 receives a force in a front direction which is a direction opposite to the mounting direction, and is shifted along the inclination of the receiving surface 80 by the force. In order to prevent the shift of the positioning member 77, the surface pressed when the positioning member 77 is shifted forms an acute angle with respect to the shift direction within two surfaces of the teeth forming the racks 77*b* and 80*a*.

Figure 4:
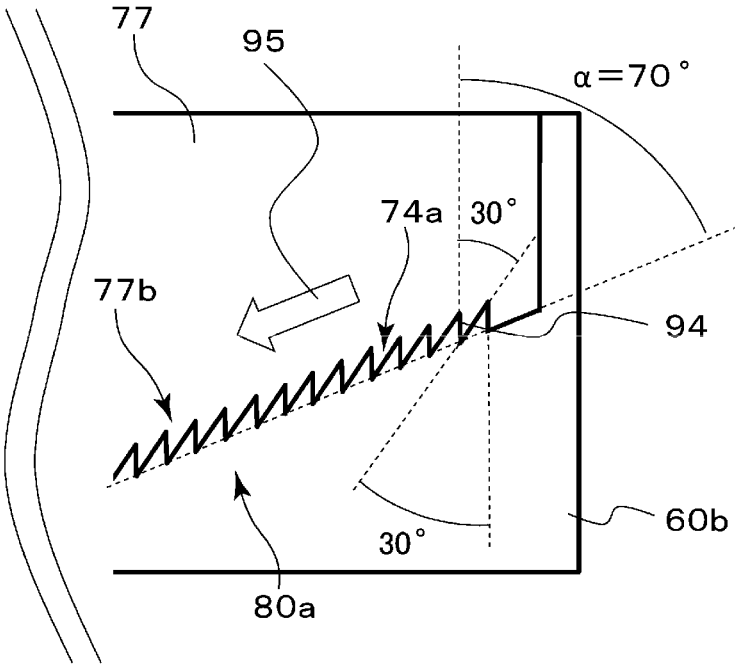
FIG. 4 is a diagram describing a positioning member constituting the positioning portion and a shape of teeth of a rack formed on a receiving surface.

Incidentally, in the present embodiment, as illustrated in FIG. 4, the surface 94 pressed when the positioning member 77 is shifted is disposed at an angle α (=70°) less than 90° with respect to the shift direction 95 within the teeth forming the respective racks 77*b* and 80*a*. Therefore, the shifting force acts as a force in a direction of biting the racks each other, and the shift of the positioning member 77 can be prevented.

Also, as illustrated in FIG. 3, the screw through-hole 96 is provided in the positioning member 77. When the positioning member 77 is fixed to the support portion 60*b*, the screw 78 is inserted into the screw through-hole 96. Incidentally, in the present embodiment, the screw through-hole 96 is formed parallel to the angle of the receiving surface 80, and the width of the screw through-hole 96 is set such that the engagement of the racks 77*b* and 80*a* has a backlash enough to shift between the screw through-hole 96 and the screw 78. Therefore, when the positioning member 77 is shifted, the positioning member 77 can be moved by just loosening the screw 78, while disengaging the racks 77*b* and 80*a*, without completely removing the screw 78, and it is possible to save the trouble of having to removing the screw 78.

Figure 5A:
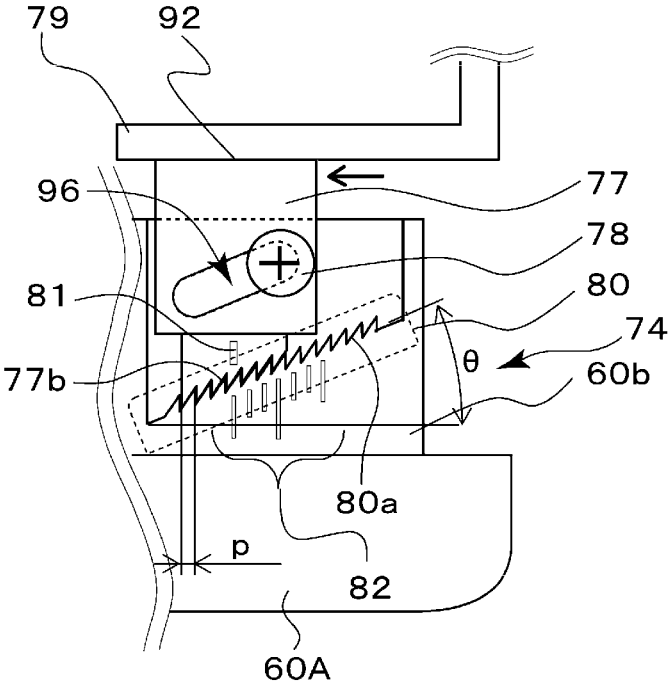
FIGS. 5A and 5B are diagrams describing a method of adjusting a position of a sheet feeding cassette by the positioning portion.

Next, a method of adjusting the positioning position of the sheet feeding cassette 60 by the adjusting portion 92A according to the present embodiment will be described with reference to FIGS. 5A and 5B. In a case where the positioning position of the sheet feeding cassette 60 is shifted to the rear side in the mounting direction, in a loosened state by loosening the screw 78 as illustrated in FIG. 5A, the racks are engaged with each other by shifting the positioning member 77 to the left side along the inclined receiving surface 80, and are then fixed by the screw 78.

By shifting the positioning member 77 to the left side, the protruding amount of the positioning member 77 from the sheet feeding cassette body 60A in the rear side direction is reduced. Therefore, when the sheet feeding cassette 60 is inserted, the sheet feeding cassette 60 abuts against the body frame 79 in a state of being further pushed to the rear side. In this manner, the position of the sheet feeding cassette 60 when the sheet feeding cassette 60 is mounted on the mounting portion 1E is adjusted to be the rear side of the image forming apparatus body.

Figure 5B:
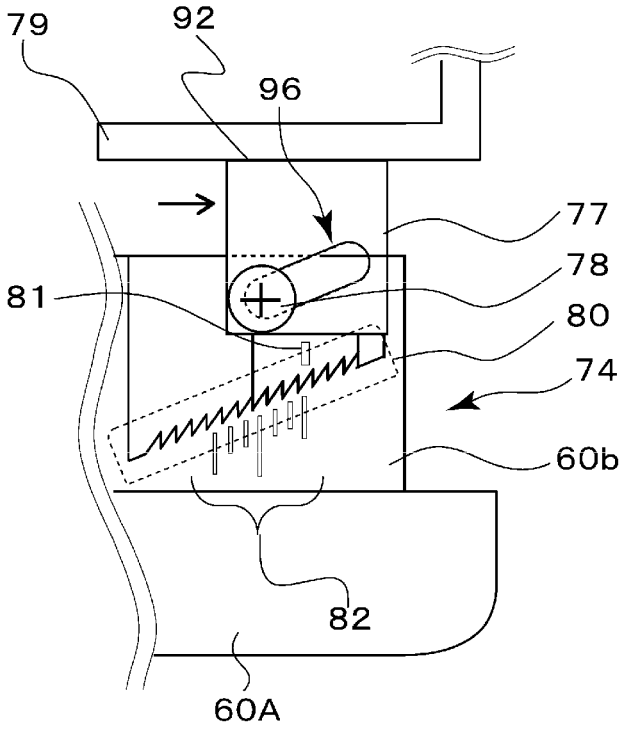

In addition, in a case where the positioning position of the sheet feeding cassette 60 is shifted to the front side in the mounting direction, in a state in which the screw 78 is loosened as illustrated in FIG. 5B, the racks are engaged with each other by shifting the positioning member 77 to the right side, and are then fixed by the screw 78. By shifting the positioning member 77 to the right side, the protruding amount of the positioning member 77 from the sheet feeding cassette body 60A in the rear side direction is increased. Therefore, when the sheet feeding cassette 60 is inserted, the sheet feeding cassette 60 abuts against the body frame 79, without being pushed to the rear side. In this manner, the position of the sheet feeding cassette 60 when the sheet feeding cassette 60 is mounted on the mounting portion 1E is adjusted to be the front side of the image forming apparatus.

Incidentally, the adjusting amount (moving amount) L of the positioning member 77 is determined by an inclination angle θ of the receiving surface 80 along which the positioning member 77 is guided, a pitch p of the teeth of the racks 77*b* and 80*a*, and the number n of the teeth of the shifted racks 77*b* and 80*a*, and can be expressed as the following equation (1).

$$L=n\times p\times\tan\theta \quad (1)$$

Incidentally, the pitch p of the teeth of the racks 77*b* and 80*a* and the inclination angle θ of the receiving surface 80 are determined by design values. Also, the shift number n of the teeth of the racks 77*b* and 80*a* is determined according to an image to be output to the printer 1 before the adjusting operation.

The position adjustment of the sheet feeding cassette 60 will be described below in detail. First, the image is output by the printer 1, the position of the end in the width direction of the sheet and the position of the image are measured, and how much the position of the image is shifted from the image forming apparatus is determined. The shifting amount is set as the adjusting amount L, and then, the shift number n of the racks 77*b* and 80*a* is determined to be closest to the necessary adjusting amount L.

Incidentally, one engraved mark 81 is formed at the substantially center in the horizontal direction of the positioning member 77, and a plurality of engraved marks 82 corresponding to the engraved mark 81 of the positioning member 77 is formed in the support portion 60*b* of the sheet feeding cassette 60. The plurality of engraved marks 82 formed in the support portion 60*b* is formed at each tooth of the rack 80*a* of the support portion 60*b*. Therefore, the number n of the teeth of the shifted racks 77*b* and 80*a* is known by moving the engraved mark 81 of the positioning member 77 while counting the engraved marks 82 of the support portion 60*b*.

The positioning member 77 can be easily moved as many as the number necessary for adjustment. As a result, the protruding amount of the positioning member 77 can be changed, and the adjustment of the positioning position of the sheet feeding cassette 60 can be performed easily and reliably. Incidentally, in the present embodiment, one engraved mark is formed in the positioning member 77 and the plurality of engraved marks is formed in the support portion 60*b*, but a plurality of engraved marks may be formed in the positioning member 77 and a plurality of engraved marks may be formed in the support portion 60*b*.

As described above, in the present embodiment, the position of the positioning member 77 is changed stepwise by the receiving surface 80 of the support portion 60*b*. Therefore, the shift of the sheet feeding cassette 60, which is positioned by the positioning portion 74, in the mounting direction with respect to the image forming portion 1B can be adjusted stepwise, and the adjustment of the positioning position of the sheet feeding cassette 60 can be performed easily and reliably.

Figure 6A:
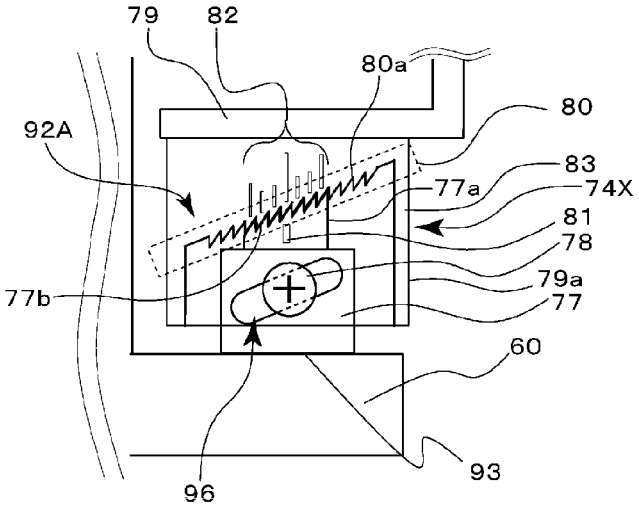
FIGS. 6A to 6C are diagrams describing a positioning portion provided in an image forming apparatus according to a second embodiment of the present invention.
Figure 6B:
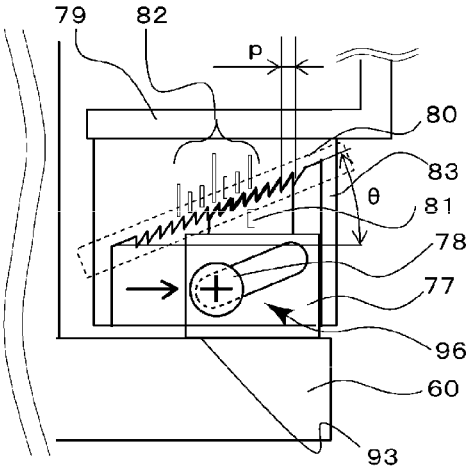
Figure 6C:
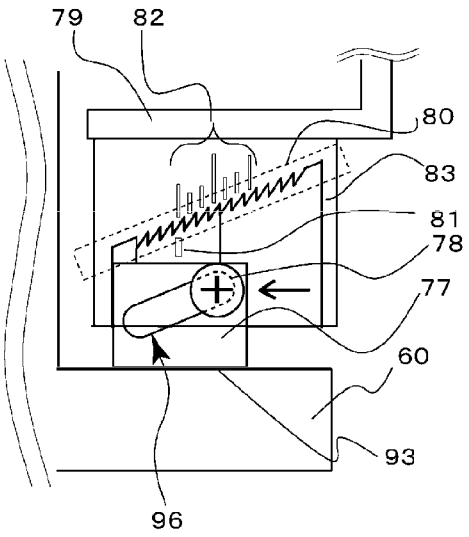

Next, a second embodiment of the present invention will be described. FIGS. 6A to 6C are diagrams describing a positioning portion of an image forming apparatus according to the present invention. Incidentally, in FIGS. 6A to 6C, the same reference signs as those in FIG. 3 denote the same or corresponding portions. In FIG. 6A, a positioning portion 74X according to the present embodiment is provided on a front side (right front side) of one end of a body frame 79 perpendicular to a mounting direction on an upstream side in a mounting direction of a sheet feeding cassette. Incidentally, the basic configuration of the image forming apparatus is substantially the same as that described in the first embodiment.

The positioning portion 74X includes a support portion 83 provided in the body frame 79, and a positioning member 77 fixed to the support portion 83 by a screw 78. When the sheet feeding cassette 60 is mounted, the positioning of the sheet feeding cassette 60 is performed in a such a manner that the positioning member 77 abuts against an abutting surface 93 which is an abutting portion of the sheet feeding cassette 60. A receiving surface 80 which is inclined with respect to the mounting direction is provided in the support portion 83, and a rack 80*a* is formed on the receiving surface 80. In the rack 80*a*, a plurality of teeth each including two surfaces inclined with respect to the receiving surface 80 is formed along the inclination of the receiving surface 80. Incidentally, in the present embodiment, an adjusting portion 92A includes the support portion 83, a latch portion 77*a* provided in the positioning member 77, a screw 78, and a screw through-hole 96 into which the screw 78 is inserted.

Also, the latch portion 77*a*, at one end of which a rack 77*b* is formed, is provided in the positioning member 77. The positioning member 77 is fixed to the body frame 79 in a state in which the rack 80*a* of the receiving surface 80 and the rack 77*b* of the latch portion 77*a* are engaged. Incidentally, the configuration of the teeth of the racks 77*b* and 80*a* is the same as the first embodiment described above (see FIG. 4). Therefore, when the sheet feeding cassette 60 is inserted, it is possible to prevent the positioning member 77 from being shifted even when the positioning member 77 collides with the abutting surface 93 of the sheet feeding cassette 60.

Also, as in the case of the first embodiment described above, the screw through-hole 96 is provided in the positioning member 77 such that the positioning member 77 is fixed to the body frame 79 through the support portion 83 by the screw 78. When the positioning member 77 is shifted, the positioning member 77 can be moved while disengaging the racks 77*b* and 80*a* by just loosening the screw 78, without completely removing the screw 78.

Next, a method of adjusting the positioning position of the sheet feeding cassette 60 by the positioning portion 74X according to the present embodiment will be described. In a case where the positioning position of the sheet feeding cassette 60 is shifted to the rear side, in a state in which the screw 78 is loosened as illustrated in FIG. 6B, the racks are engaged with each other by shifting the positioning member 77 to the right side, and are then fixed by the screw 78. By shifting the positioning member 77 to the right side, the protruding amount of the positioning member 77 from the body frame 79 to the front side is reduced. Therefore, when the sheet feeding cassette 60 is inserted, the sheet feeding cassette 60 abuts against the positioning member 77 in a state of being further pushed to the rear side. In this manner, the position of the sheet feeding cassette 60 when the sheet feeding cassette 60 is mounted on the mounting portion 1E is adjusted to the rear side.

Also, in a case where the positioning position of the sheet feeding cassette 60 is shifted to the front side, in a state in which the screw 78 is loosened as illustrated in FIG. 6C, the racks are engaged with each other by shifting the positioning member 77 to the left side, and are then fixed by the screw 78. By shifting the positioning member 77 to the left side, the protruding amount of the positioning member 77 from the body frame 79 to the front side is increased. Therefore, when the sheet feeding cassette 60 is inserted, the sheet feeding cassette 60 abuts against the positioning member 77, without being pushed to the rear side. In this manner, the position of the sheet feeding cassette 60 when the sheet feeding cassette 60 is mounted on the mounting portion 1E is adjusted to the front side. Incidentally, the specific adjustment of the position of the sheet feeding cassette 60 and the adjustment of the position of the image in the image forming portion 1B are the same as those described in the first embodiment.

As described above, in the present embodiment, the position of the positioning member 77 provided in the body frame 79 is changed stepwise by the receiving surface 80 of the support portion 60*b* provided in the body frame 79. Therefore, the shift of the sheet feeding cassette 60, which is positioned by the positioning portion 74X, in the mounting direction with respect to the image forming portion 1B can be adjusted stepwise, and the adjustment of the positioning position of the sheet feeding cassette 60 can be performed easily and reliably.

Figure 7:
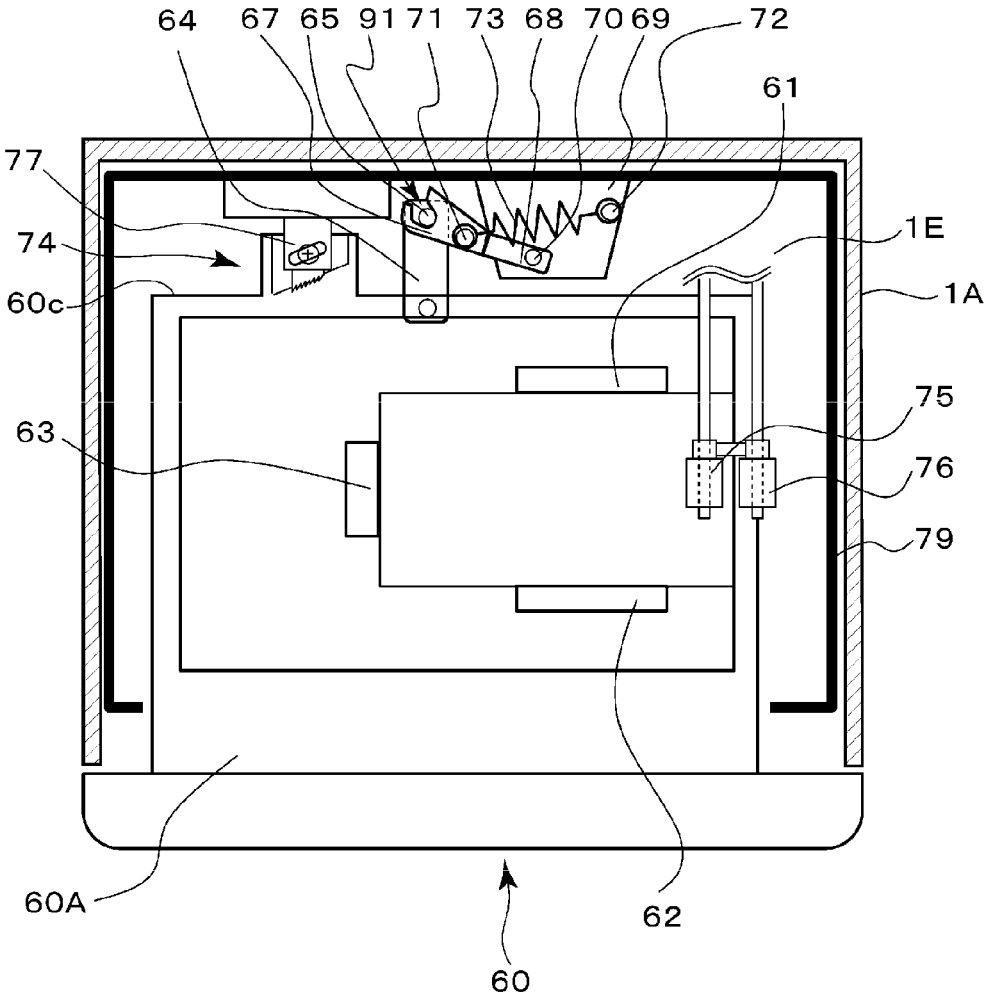
FIG. 7 is a diagram describing another configuration of the mounting portion and the sheet feeding cassette drawably mounted on the mounting portion in the full-color laser beam printer according to the first embodiment.

Incidentally, in the present embodiment, the positioning portion 74X is disposed on the right front side of the body frame 79, but the positioning portion 74X may be disposed on the rear side of the body frame 79. Also, similarly, in the first embodiment described above, the positioning portion 74 is disposed on the right end of the sheet feeding cassette 60, but the positioning portion 74 may be disposed on the rear side of the sheet feeding cassette 60 as illustrated in FIG. 7.

The case of changing stepwise the position of the positioning member 77 protruding on the other of the sheet feeding cassette 60 and the printer body 1A at one of the sheet feeding cassette 60 and the printer body 1A has been described, but the present invention is not limited thereto. For example, even in the case of regulating the position of the sheet feeding cassette 60 by the positioning hook and the positioning pin, the position of the positioning hook and the positioning pin may be changed stepwise.

Figure 8:
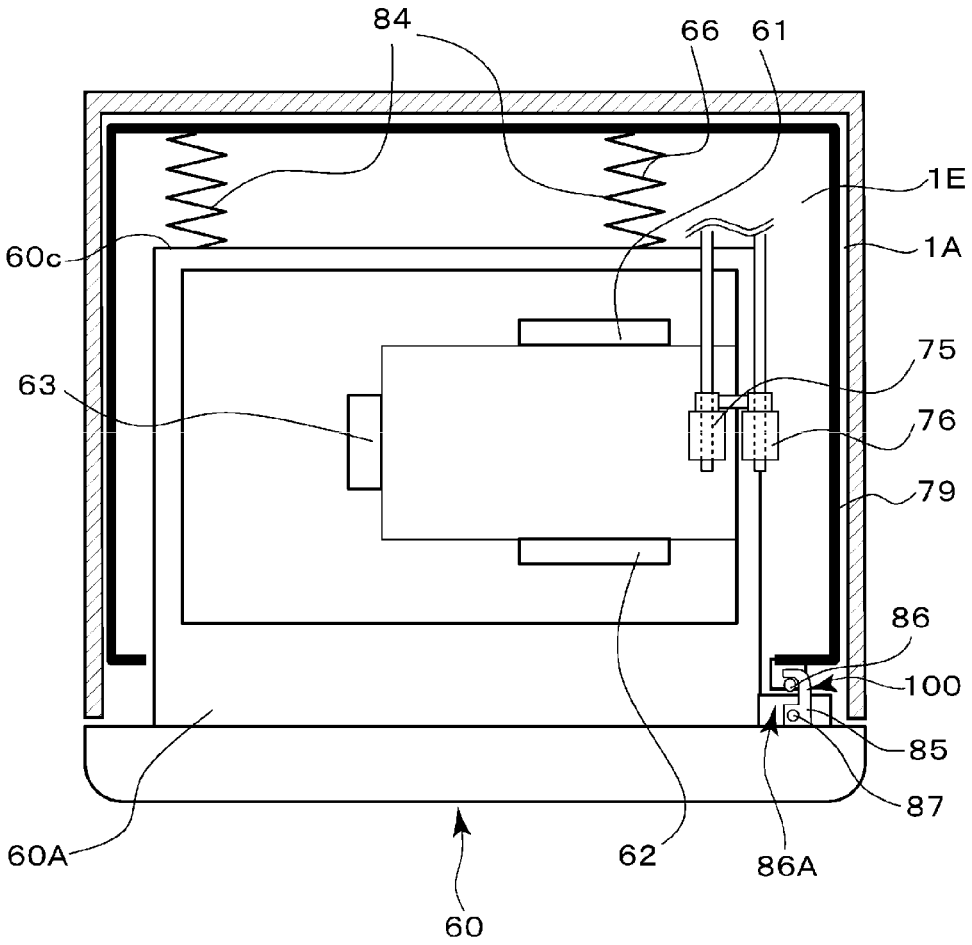
FIG. 8 is a diagram describing a configuration of a mounting portion and a sheet feeding cassette drawably mounted on the mounting portion in an image forming apparatus according to a third embodiment.

Next, a third embodiment of the present invention will be described. FIG. 8 is a diagram describing a configuration of a mounting portion and a sheet feeding cassette drawably mounted on the mounting portion in an image forming apparatus according to the present embodiment. Incidentally, in FIG. 8, the same reference signs as those in FIG. 2 denote the same or corresponding portions. In FIG. 8, a cassette biasing spring 84 is a biasing portion which is provided on a rear inner-wall surface of a mounting portion 1E and biases a sheet feeding cassette 60 to a front side. Also, a positioning hook 85 is a latch member which is swingably provided in the sheet feeding cassette 60. When the sheet feeding cassette 60 is mounted, the positioning hook 85 is latched to a positioning pin 86 which is a to-be-latched member provided in the mounting portion 1E.

Incidentally, the positioning hook 85 is biased counterclockwise by a biasing portion (not illustrated). When the sheet feeding cassette 60 is mounted, the positioning hook 85 abuts against the positioning pin 86 and is rotated clockwise against the biasing portion. After that, when passing through the positioning pin 86, the positioning hook 85 is rotated counterclockwise by the biasing portion and latches the positioning pin 86. By latching the positioning hook 85 to the positioning pin 86, the positioning hook 85 receives the biasing force of the cassette biasing spring 84, and the positioning in the front rear direction of the sheet feeding cassette 60 is performed. Therefore, in the present embodiment, the positioning hook 85 and the positioning pin 86 constitute a positioning portion 86A which performs the positioning of the sheet feeding cassette 60 biased by the cassette biasing spring 84.

The positioning hook 85 swings in interlocking with a lever (not illustrated) or a button (not illustrated) as described below, and the latching of the positioning pin 86 is released. Incidentally, when the sheet feeding cassette 60 is pulled out, if the latching of the positioning pin 86 by the positioning hook 85 is released by operating the lever or the button, the sheet feeding cassette 60 protrudes from the printer body 1A by the biasing force of the cassette biasing spring 84.

Figure 9A:
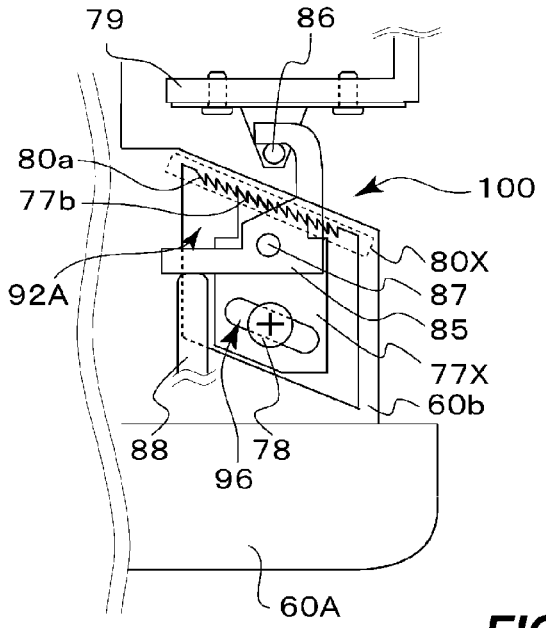
FIGS. 9A to 9C are diagrams describing a positioning portion provided in the image forming apparatus.
Figure 9B:
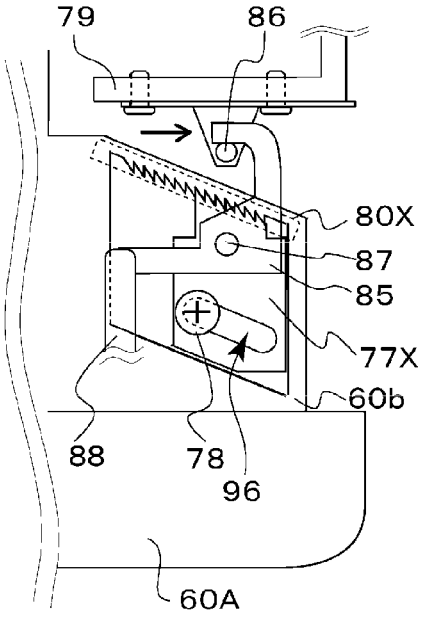
Figure 9C:
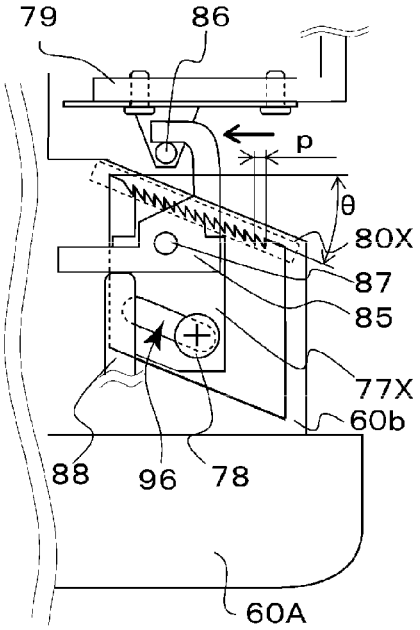

Also, in FIG. 8, a positioning portion 100 is provided at one end of a sheet feeding cassette body 60A which is perpendicular to a mounting direction upstream of the mounting direction of the sheet feeding cassette body 60A. When the sheet feeding cassette 60 is inserted into the mounting portion 1E, the positioning portion 100 performs the positioning of the sheet feeding cassette 60. As illustrated in FIGS. 9A to 9C, the positioning portion 100 includes a support portion 60*b* provided in the sheet feeding cassette body 60A, and a positioning member 77X fixed to the support portion 60*b* by a screw 78. Incidentally, in the present embodiment, an adjusting portion 92A includes the support portion 60*b*, the positioning member 77X, a screw 78, and a screw through-hole 96 into which the screw 78 is inserted.

A receiving surface 80X which is inclined with respect to the mounting direction is provided in the support portion 60*b*, and a rack 80*a* is formed on the receiving surface 80X. In the rack 80*a*, a plurality of teeth each including two surfaces inclined with respect to the receiving surface 80X is formed along the inclination of the receiving surface 80X. Also, a rack 77*b* is formed at one end of the positioning member 77X. The positioning member 77X is fixed to the sheet feeding cassette 60 in a state in which the rack 80*a* of the receiving surface 80 and the rack 77*b* are engaged.

Also, in the positioning member 77X, the positioning hook 85 is swingably provided through a supporting point 87. By shifting the position of the positioning member 77X, the protruding amount of the positioning hook 85 from the sheet feeding cassette 60 to the rear side direction, that is, to the printer body side, is changed. That is, in the present embodiment, the position of the positioning hook 85 is changed stepwise.

In FIGS. 9A to 9C, a release bar 88 abuts against the positioning hook 85. The release bar 88 is inserted into the rear side by the operation of the lever (not illustrated) or the button (not illustrated). By pushing the release bar 88 into the rear side, the positioning hook 85 is swung to release the positioning pin 86, and the fixing of the sheet feeding cassette 60 is released.

Incidentally, in the present embodiment, the inclination direction of the receiving surface 80X is reverse to the inclination direction of the receiving surface 80 of the first embodiment described above. Also, the inclination direction of the rack 77*b* of the positioning member 77X is reverse to the inclination direction of the rack 77*b* of the positioning member 77 of the first embodiment described above. This is because the biasing direction of the sheet feeding cassette 60 by the cassette biasing spring 84 according to the present embodiment is reverse to the biasing direction of the sheet feeding cassette 60 by the guiding unit 66 according to the first embodiment described above.

That is, in the present embodiment, the inclination directions of the rack 80*a* of the receiving surface 80X and the rack 77*b* of the positioning member 77X are set such that the positioning hook 85 and the positioning member 77X can receive the biasing force of the cassette biasing spring 84. Also, by setting the inclination directions of the receiving surface 80X and the rack 77*b* of the positioning member 77X, it is possible to prevent the positioning member 77X from being shifted even when the positioning member 77X receives the force toward the front side after the sheet feeding cassette 60 is inserted.

Next, a method of adjusting the positioning position of the sheet feeding cassette 60 by the positioning portion 100 according to the present embodiment will be described. In a case where the positioning position of the sheet feeding cassette 60 is shifted to the rear side in the mounting direction, in a state in which the screw 78 is loosened as illustrated in FIG. 9B, the racks are engaged with each other by shifting the positioning member 77X to the right side, and are then fixed by the screw 78. Incidentally, in the present embodiment, the positioning pin 86 also can be moved in the direction perpendicular to the mounting direction. In a case where the positioning member 77X is shifted, the positioning pin 86 also is moved in the same direction by the same amount.

By shifting the positioning member 77X to the right side, the protruding amount of the positioning hook 85 from the sheet feeding cassette 60 to the rear side is reduced. Therefore, when the sheet feeding cassette 60 is inserted, the positioning hook 85 is latched to the positioning pin 86 in a state in which the sheet feeding cassette 60 is further pushed toward the rear side. In this manner, the position of the sheet feeding cassette 60 when the sheet feeding cassette 60 is mounted on the mounting portion 1E is adjusted to the rear side.

In a case where the sheet feeding cassette 60 is shifted to the front side, the positioning pin 86 is shifted to the left side. Also, in a state in which the screw 78 is loosened as illustrated in FIG. 9C, the racks are engaged with each other by shifting the positioning member 77X to the left side, and are then fixed by the screw 78. By shifting the positioning member 77X to the left side, the protruding amount of the positioning hook 85 from the sheet feeding cassette 60 to the rear side is increased. Therefore, when the sheet feeding cassette 60 is inserted, the sheet feeding cassette 60 is latched to the positioning pin 86, without being pushed to the rear side. In this manner, the position of the sheet feeding cassette 60 when the sheet feeding cassette 60 is mounted on the mounting portion 1E is adjusted to the front side.

As described above, in the present embodiment, the position of the positioning hook 85 is changed stepwise by changing stepwise the position of the positioning member 77X by the receiving surface 80 of the support portion 60*b*. Therefore, the shift of the sheet feeding cassette 60, which is positioned by the positioning hook 85 and the positioning pin 86, in the mounting direction with respect to the image forming portion 1B can be adjusted stepwise, and the adjustment of the positioning position of the sheet feeding cassette 60 can be performed easily and reliably.

Figure 10A:
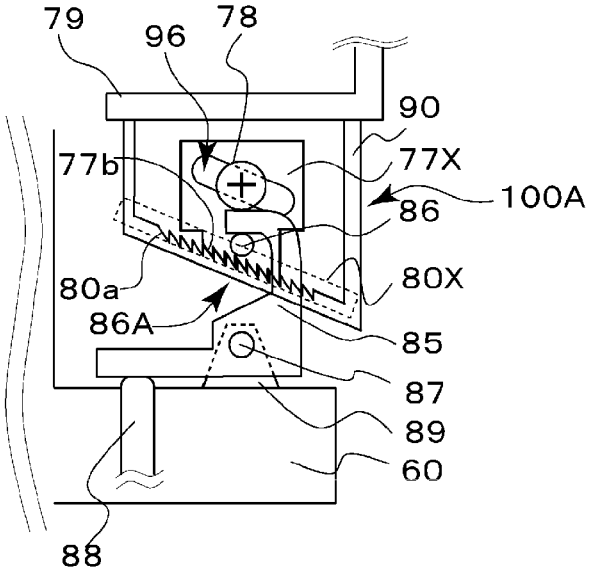
FIGS. 10A to 10C are diagrams describing a positioning portion provided in an image forming apparatus according to a fourth embodiment of the present invention.
Figure 10B:
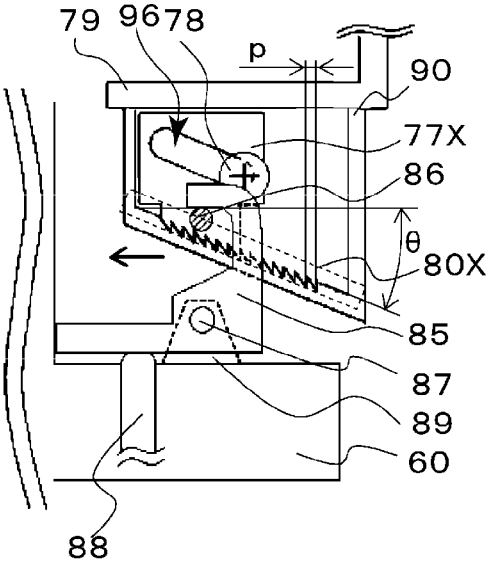
Figure 10C:
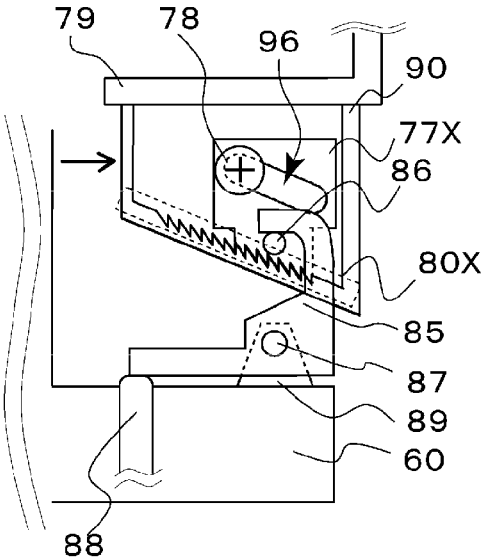

Next, a fourth embodiment of the present invention will be described. FIGS. 10A to 10C are diagrams describing a positioning portion provided in an image forming apparatus according to the present embodiment of the present invention. Incidentally, in FIGS. 10A to 10C, the same reference signs as those in FIGS. 9A to 9C denote the same or corresponding portions. In FIG. 10A, a positioning portion 100A according to the present embodiment is provided in a body frame 79.

The positioning portion 100A includes a support portion 90 provided in the body frame 79, and a positioning member 77X fixed to the support portion 90 by a screw 78. A receiving surface 80X which is inclined with respect to the mounting direction is provided in the support portion 90, and a rack 80*a* is formed on the receiving surface 80X. In the rack 80*a*, a plurality of teeth each including two surfaces inclined with respect to the receiving surface 80X is formed along the inclination of the receiving surface 80X. Also, a rack 77*b* is formed at one end of the positioning member 77X. The positioning member 77X is fixed to the body frame 79 in a state in which the rack 80*a* of the receiving surface 80 and the rack 77*b* are engaged.

Also, the positioning pin 86 is provided in the positioning member 77X. By shifting the position of the positioning member 77X, the protruding amount of the positioning pin 86 from the body frame 79 to the front side direction, that is, to the printer body side, is changed. That is, in the present embodiment, the position of the positioning pin 86 is changed stepwise.

Incidentally, in the present embodiment, the inclination direction of the receiving surface 80X is reverse to the inclination direction of the receiving surface 80 of the second embodiment described above. Also, the inclination direction of the rack 77*b* of the positioning member 77X is reverse to the inclination direction of the rack 77*b* of the positioning member 77 of the second embodiment described above. This is because the biasing direction of the sheet feeding cassette 60 by the cassette biasing spring 84 according to the present embodiment is reverse to the biasing direction of the sheet feeding cassette 60 by the guiding unit 66 according to the second embodiment described above.

That is, in the present embodiment, the inclination directions of the rack 80*a* of the receiving surface 80X and the rack 77*b* of the positioning member 77X are set such that the positioning hook 85 and the positioning member 77X can receive the biasing force of the cassette biasing spring 84. Also, by setting the inclination directions of the receiving surface 80X and the rack 77*b* of the positioning member 77X, it is possible to prevent the positioning member 77X from being shifted even when the positioning member 77X receives the force toward the front side after the sheet feeding cassette 60 is inserted.

Also, in the present embodiment, a supporting point 87 of the positioning hook 85 is disposed in a supporting point holding member 89 on the sheet feeding cassette 60. The supporting point holding member 89 is horizontally movable on the sheet feeding cassette 60. Also, a release bar 88 contacts a part of the positioning hook 85. The release bar 88 is pushed to the rear side by operating a lever (not illustrate) or a button (not illustrated). Therefore, the positioning hook 85 is swung to release the fixing of the sheet feeding cassette 60.

Next, a method of adjusting the positioning position of the sheet feeding cassette 60 by the positioning portion 100A according to the present embodiment will be described. In a case where the positioning position of the sheet feeding cassette 60 is shifted to the rear side, as illustrated in FIG. 10B, the supporting point holding member 89 is shifted to the left side, and the racks are engaged with each other by shifting the positioning member 77X to the left side in a state in which the screw 78 is loosened, and are then fixed by the screw 78. Incidentally, in the present embodiment, an adjusting portion 92A includes the support portion 90, a latch portion 77*a* provided in the positioning member 77X, the screw 78, and a screw through-hole 96 into which the screw 78 is inserted.

By shifting the positioning member 77X to the left side, the positioning pin 86 is moved to the rear side. Therefore, when the sheet feeding cassette 60 is inserted, the positioning hook 85 is latched to the positioning pin 86 in a state in which the sheet feeding cassette 60 is further pushed toward the rear side. In this manner, the position of the sheet feeding cassette 60 when the sheet feeding cassette 60 is mounted on the mounting portion 1E is adjusted to the rear side.

In a case where the positioning position of the sheet feeding cassette 60 is shifted to the front side, as illustrated in FIG. 10C, the supporting point holding member 89 is shifted to the right side, and the racks are engaged with each other by shifting the positioning member 77X to the right side in a state in which the screw 78 is loosened, and are then fixed by the screw 78. By shifting the positioning member 77X to the right side, the positioning pin 86 is moved to the front side. Therefore, when the sheet feeding cassette 60 is inserted, the positioning hook 85 is latched to the positioning pin 86, without pushing the sheet feeding cassette 60 to the rear side. In this manner, the position of the sheet feeding cassette 60 when the sheet feeding cassette 60 is mounted on the mounting portion 1E is adjusted to the front side.

As described above, in the present embodiment, the position of the positioning pin 86 is changed by changing stepwise the position of the positioning member 77X by the receiving surface 80 of the support portion 60*b*. Therefore, the shift of the sheet feeding cassette 60, which is positioned by the positioning hook 85 and the positioning pin 86, in the mounting direction with respect to the image forming portion 1B can be adjusted stepwise, and the adjustment of the positioning position of the sheet feeding cassette 60 can be performed easily and reliably.

Incidentally, in the third and fourth embodiments described above, the case where the positioning hook 85 is provided in the sheet feeding cassette 60 and the positioning pin 86 is provided in the mounting portion 1E, but the present invention is not limited thereto. For example, the present invention can also be applied to a case where the positioning pin 86 is provided in the sheet feeding cassette 60 and the positioning hook 85 is provided in the mounting portion 1E.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-192766, filed Sep. 18, 2013, which is hereby incorporated by reference herein in its entirety.

What is claimed is:

1. An image forming apparatus comprising:

an image forming portion;

a sheet storing portion which is drawably mounted on an image forming apparatus body;

a sheet feeding portion which feeds a sheet stored in the sheet storing portion in a direction perpendicular to a mounting direction of the sheet storing portion;

a biasing portion which biases the sheet storing portion which is mounted in the image forming apparatus body in a direction opposite to the mounting direction;

a positioning portion which performs positioning of the sheet storing portion mounted on the image forming apparatus body in a mounting direction, wherein the positioning portion includes a latch portion which is provided in one of the sheet storing portion and the image forming apparatus body and a to-be-latched portion which is provided in the other of the sheet storing portion and the image forming apparatus body, and wherein the sheet storing portion is positioned by abutting the latch portion against the to-be-latched portion due to a biasing force by the biasing portion in the mounting direction; and an adjusting portion which adjusts the positioning portion so as to adjust a positioning position of the sheet storing portion in the mounting direction, wherein the adjusting portion includes a first teeth portion which has a plurality of teeth formed on a inclined surface inclined in a direction oblique to the mounting direction and a second teeth portion which has a plurality of teeth on a surface which faces the inclined surface and an engagement position between the teeth of the first teeth portion and the teeth of the second teeth portion is changeable by moving of the first teeth portion in the direction oblique to the mounting direction, and wherein the first teeth portion is provided on the latch portion or the to-be-latched portion and the positioning position of the sheet storing portion in the mounting direction is adjusted by moving of the first teeth portion.

2. The image forming apparatus according to claim 1, wherein the latch portion includes a latch member and a positioning member which holds the latch member, wherein the latch portion is supported by a support portion, and wherein the first teeth portion is provided on the positioning member and the second teeth portion is provided on the support portion.

3. The image forming apparatus according to claim 2, further comprising a fixing portion which fixes the support portion and the positioning member, wherein the fixing portion is capable of fixing the engagement position between the first teeth portion of the positioning member and the second teeth portion of the support portion to a changed position.

4. The image forming apparatus according to claim 2, wherein the to-be-latched portion is movable in a direction perpendicular to the mounting direction.

5. The image forming apparatus according to claim 1, wherein the to-be-latched portion includes a to-be-latched member and a positioning member which holds the to-be-latched member, wherein the to-be-latched portion is supported by a support portion, and wherein the first teeth portion is provided on the positioning member and the second teeth portion is provided on the support portion.

6. The image forming apparatus according to claim 5, further comprising a fixing portion which fixes the support portion and the positioning member, wherein the fixing portion is capable of fixing the engagement position between the first teeth portion of the positioning member and the second teeth portion of the support portion to a changed position.

7. The image forming apparatus according to claim 5, wherein the to-be-latched portion is movable in a direction perpendicular to the mounting direction.

8. The image forming apparatus according to claim 1, wherein the latch portion includes a hook, and wherein the to-be-latched portion includes a positioning pin to be latched to the hook.

9. The image forming apparatus according to claim 2, wherein the teeth of the first teeth portion and the teeth of the second teeth portion are triangular teeth each having two inclined surfaces, and wherein when the positioning member abuts against an abutting portion and a force is applied, pressing an inclined surface of a tooth of the first teeth portion against an inclined surface of a tooth of the second teeth portion, the pressed surfaces forming an acute angle with respect to a shift direction.

* * * * *